US005476428A

United States Patent [19]

Potash et al.

[11] Patent Number: 5,476,428

[45] Date of Patent: Dec. 19, 1995

[54] ASYMMETRIC FORCE APPLICATOR ATTACHMENT FOR WEIGHT STACK TYPE EXERCISE MACHINES

[75] Inventors: Richard J. Potash; Robert L. Potash, both of Dedham; Wojciech J. Krawiec, Waltham; Stephen K. Burns, Durham, all of Mass.

[73] Assignee: Computer Sports Medicine, Inc., Waltham, Mass.

[21] Appl. No.: 212,346

[22] Filed: Mar. 10, 1994

Related U.S. Application Data

[63] Continuation-in-part of Ser. No. 65,589, May 20, 1993, Pat. No. 5,328,429.

[51] Int. Cl.[6] ..... A63B 21/005; A63B 21/06

[52] U.S. Cl. ..... 482/5; 482/99

[58] Field of Search ..... 482/1–9, 97–104, 482/106

[56] References Cited

U.S. PATENT DOCUMENTS 4,921,244 5/1990 Berroth ..... 482/9

*Primary Examiner*—Richard J. Apley
*Assistant Examiner*—John Mulcahy
*Attorney, Agent, or Firm*—Arthur L. Lessler

[57] ABSTRACT

An attachment for a weight stack type exercise machine to pull the weight stack down while it is being lowered, (or to pull on a weight stack lifting means so as to add to the force applied to the lifting means by the weight stack) so that the eccentric exercise force required to lower the stack is greater than the concentric exercise force required to raise it. Such asymmetric exercise forces more closely match muscle strengths, which are normally greater for eccentric exercise than for concentric exercise. The attachment has an electric motor and a control unit including a keypad, a display and a microcontroller. The motor is coupled to the weight stack by an eccentric force control cable or a toothed belt or alternatively is operatively connected so as to apply additional force to the lifting arrangement. The keypad allows the user to select the amount of force added during the eccentric phase of exercise, when the weight stack is moving down. A sensor enables the controller to determine whether the weight stack is moving up or down. As the weights in the stack are being raised, no significant force is generated by the motor and eccentric force control cable or belt. As the weights are being lowered, an amount of additional (i.e. in addition to gravity) eccentric force selected by the user via the keypad is applied to the weight stack or lifting arrangement by the motor via the eccentric force control cable, or to the toothed belt.

19 Claims, 15 Drawing Sheets

ASYMMETRIC FORCE APPLICATOR ATTACHMENT FOR WEIGHT STACK TYPE EXERCISE MACHINES

This application is a continuation-in-part of prior application Ser. No. 08/065,589 filed May 20, 1993, now U.S. Pat. No. 5,328,429.

BACKGROUND OF THE INVENTION

This invention relates to a device especially suited for but not limited to, use as an attachment to a weight stack type exercise machine, for generating greater exercise resistance when the weight stack is moving in one direction (corresponding to eccentric muscle movements) than when the stack is moving in the opposite direction (corresponding to concentric muscle movements).

Weight stack type exercise machines have a stack of weights with a pin or other device to connect a selected number of the weights to one end of a lifting means (cable, belt or bar), the other end of the lifting means being connected to a handlebar, pivotally mounted leg bar, or other movable member for engaging part of the body. Large numbers of such machines are currently in use.

Such conventional weight stack type exercise machines require the user to exert the same amount of force to gradually lift the weight stack as to gradually lower the weight stack. During the weight stack lifting phase of an exercise the muscles involved contract or shorten, involving concentric muscle movements; whereas during the weight stack lowering phase the muscles involved lengthen, involving eccentric muscle movements.

Therefore such conventional weight stack type exercise machines are limited to presenting the same resistance to eccentric muscle movements as to concentric muscle movements.

However, muscles can generate significantly greater force during eccentric (muscle lengthening) exercise motions than during concentric (muscle shortening) exercise motions.

This difference between concentric and eccentric movements has been recognized, and various approaches have been taken to provide increased resistance during eccentric movements.

In one approach athletes work out in pairs on weight stack type and other exercise machines, or simply by lifting weights without a machine. The person who is exercising raises and lowers the weights. The second person either assists during the concentric phase or presses down on the weight to add force during the eccentric phase.

Machines are known in the art which are capable of applying greater forces during eccentric movements than the forces applied during the opposite, or concentric movements. Such machines are relatively complex and expensive, and have not been well accepted.

In FIGS. 5 and 6 of U.S. Pat. No. 5,011,142 to Eckler entitled Exercise Control System, a weight stack 88 is supported by a piston rod 76 of a pneumatic cylinder 92, the piston rod being connected to a double acting piston 90 within the cylinder. A bidirectional valve 60 controls the air pressure supplied to the upper and lower surfaces of the piston 90, to add or subtract resistance to the exerciser's effort to raise or lower the weight stack 88. This arrangement, however, is unduly mechanically complex and limited by piston stroke length; and cannot readily be incorporated in existing weight stack type exercise machines.

U.S. Pat. No. 5,015,926 to Casler, entitled Electronically Controlled Force Application Mechanism For Exercise Machines, does not utilize a weight stack, but rather employs a continuously running DC motor, the motor being coupled to an exercise member via a variable torque magnetic particle clutch controlled by a microprocessor to vary the exercise resistance in response to the exercise force, speed and direction of motion. This system is mechanically complex and not suited for incorporation in existing weight stack type exercise machines.

U.S. Pat. No. 4,765,613 to Voris, entitled Progressive Resistance Exercise Device, provides progressively increasing exercise resistance in the (concentric) exercise direction, while reducing the resistance to zero in the opposite (eccentric) direction.

U.S. Pat. No. 5,117,170 to Keane et al., entitled Motor Control Circuit For A Simulated Weight Stack, employs a DC motor to simulate a weight stack, providing exercise resistance which is electrically controllable.

U.S. Pat. No. 5,133,545 to Moschetti et al., entitled Progressive Accommodating Resistance Exercise Device, has cables which can be pulled by the user in order to exercise. FIG. 6 of this reference shows a drum 158 around which is wound a cable 162, with a governor and friction brake mechanism for varying the resistance presented to rotation of the drum as the cable winds on or unwinds from the drum. The faster the cable is pulled, the faster the governor spins and the harder it presses on the brake.

Other references of interest are:

| U.S. Pat. No. | Inventor | Title |
|---|---|---|
| 3,912,261 | Lambert, Sr. | Exercise Machine |
| 4,511,137 | Jones | Compound Weight Lifting Exercising Machine |
| 4,609,189 | Brasher | Operator Controlled Variable Force Exercising Machine |
| 4,623,146 | Jackson | Exercise Machine |
| 4,650,185 | Cartwright | Exercise Machine With Improved Load Varying Arrangement |
| 4,846,466 | Stima, III | Microprocessor Controlled Electro-Hydraulic Exercise System |
| 5,037,089 | Spagnuolo et al. | Exercise Device Having Variable Resistance Capability |
| 5,106,081 | Webb | Leg Exercise Machine |
| 3,869,121 | Flavell | Proportioned Resistance Exercise Servo System |
| 4,261,562 | Flavell | Electromagnetically Regulated Exerciser |
| 4,540,171 | Clark et al. | Variable Resistance Exercise Apparatus |
| 4,546,971 | Raasoch | Exercise Device |
| 4,563,003 | Bugallo et al. | Weight Lifting Apparatus Having Increased Force on the Return Stroke |
| 4,746,113 | Kissel | Automatically Adjustable Exercise Equipment, and Control System and Method Therefore |
| 4,779,865 | Lieberman et al. | Exercise/Therapy Support System |
| 4,822,037 | Makansi et al. | Resistance Control System for Muscle Therapy/Exercise/Training and Strength Measurement |

-continued

| U.S. Pat. No. | Inventor | Title |
|---|---|---|
| 4,848,738 | Mueller | Weight Stack with Vacuum-Actuated Pneumatic Motor for Lift Assist |
| 4,907,795 | Shaw et al. | Computerized Exercise Monitoring System and Method for Monitoring a User's Exercise Performance |
| 4,921,244 | Berroth | Apparatus for Positive Muscle Training |
| 5,011,142 | Eckler | Exercise Control System |
| 5,020,794 | Englehardt et al. | Motor Control for an Exercise Machine Simulating a Weight Stack |
| 5,037,089 | Spagnuolo et al. | Exercise Device Having Variable Resistance Capability |
| 5,048,826 | Ryan | Safety Apparatus for Use With Barbell Assembly |
| 5,147,263 | Mueller | Pneumatic Weight Lift Assist Apparatus |
| 5,151,071 | Jain et al. | Isoinertial Lifting Device |
| 5,230,672 | Brown et al. | Computerized Exercise, Physical Therapy, or Rehabilitation Apparatus with Improved Features |

None of the aforementioned references is capable of, or suitable for installation on existing weight stack type exercise equipment at reasonable cost without limiting the range of movement of the weight, so as to provide eccentric resistance which is adjustably greater than the concentric resistance of the equipment.

Accordingly, an object of the present invention is to provide apparatus suitable for use as an attachment to a weight stack type exercise machine, for generating greater exercise resistance in one direction (corresponding to eccentric muscle movements) than in the opposite direction (corresponding to concentric muscle movements).

SUMMARY OF THE INVENTION

As herein described, there is provided an attachment for an exercise machine having at least one weight and lifting means for lifting the weight; where the lifting means has one part coupled to the weight and another part coupled to an exercise member.

The attachment has force incrementing means adapted to subject the exercise member to a variable incremental force. The force incrementing means includes incremental force generating means adapted to engage a movable element of the exercise machine which is coupled to the exercise member, to apply an incremental force to the movable element.

The force incrementing means also has control means for varying the incremental force in accordance with a force increment control signal.

The attachment has sensing means adapted to provide an output signal indicative of a direction of movement of the exercise member.

Manually operable input means which is part of the attachment generates a weight increment signal.

A microcontroller included in the attachment is coupled to the sensing means, the input means and the force incrementing means, and generates the force increment control signal to vary the incremental force in accordance with the weight increment signal and the output signal.

With this arrangement the incremental force generating means applies a substantially greater, by a user selectable increment, force to the movable element of the exercise machine when the exercise member is moving in the aforementioned direction than when the exercise member is moving in another direction. The result is that the combined forces coupled to the exercise member by the weight and the incremental force generating means vary substantially with the direction of movement of the exercise member.

According to a preferred embodiment of the invention, there is provided an attachment for a weight stack type exercise machine having a weight stack and lifting means for manually raising and lowering the stack.

The attachment includes a drive motor and a coupling between the drive motor and the weight stack or lifting means which raises and lowers the weight stack for applying a force to the lifting means or weight stack which varies in accordance with the torque generated by the motor. A sensor which is associated with the motor or a power transmission driven by the motor determines the magnitude and direction of the speed of the motor or the portion of the transmission which applies force to the lifting means or weight stack.

A microcontroller is coupled to the sensing means and the motor for varying the torque generated by the motor in accordance with an eccentric force input signal and the output of the sensing means, to cause application of (i) minimal force to the lifting means or weight stack when a predetermined part of the lifting means is moving in one direction, and (ii) a predetermined force to the lifting means or weight stack corresponding to the eccentric force input signal when a predetermined part of the lifting means is moving in the opposite direction.

IN THE DRAWING

Figure 7:
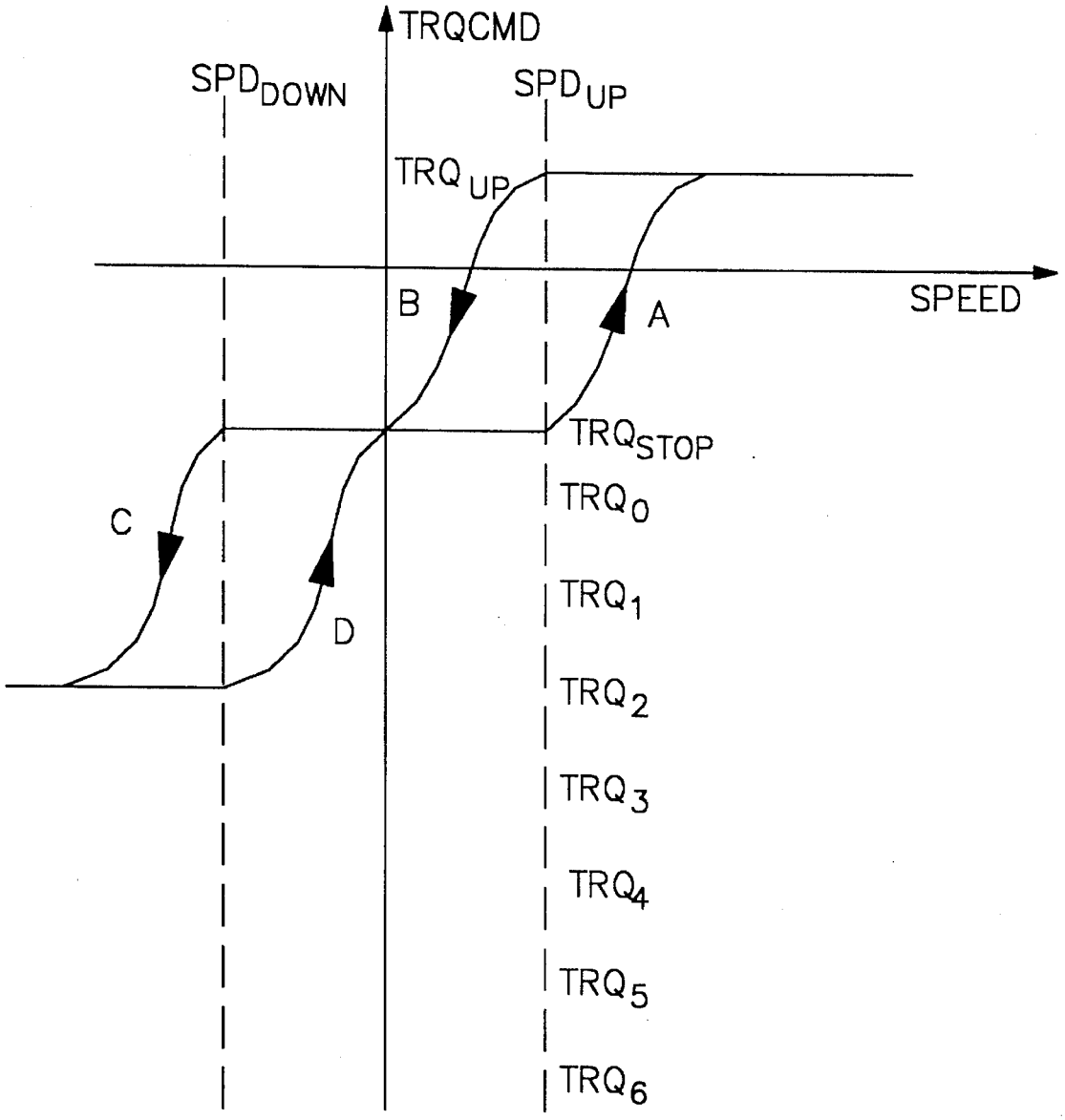
Figure 8:
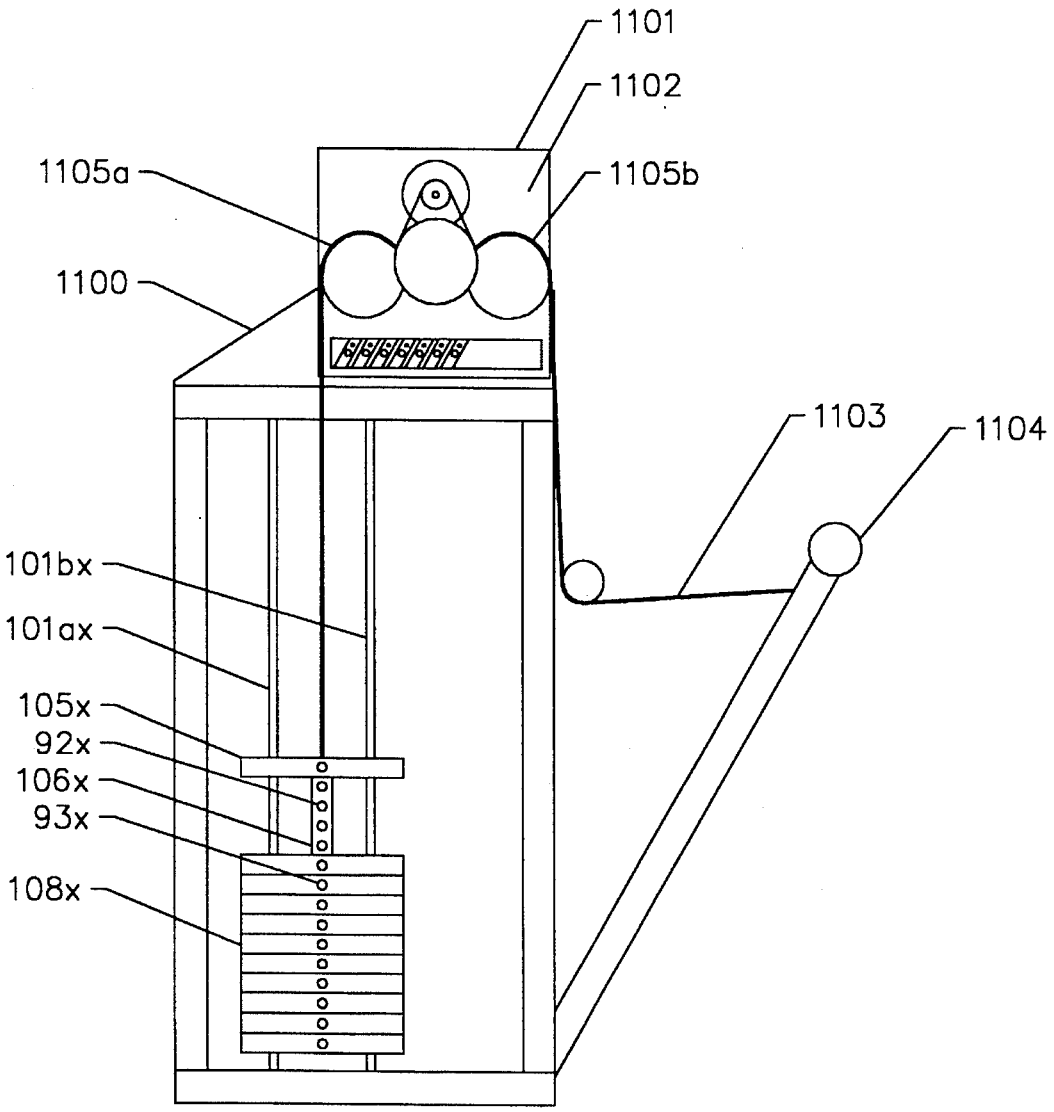
Figure 9A:
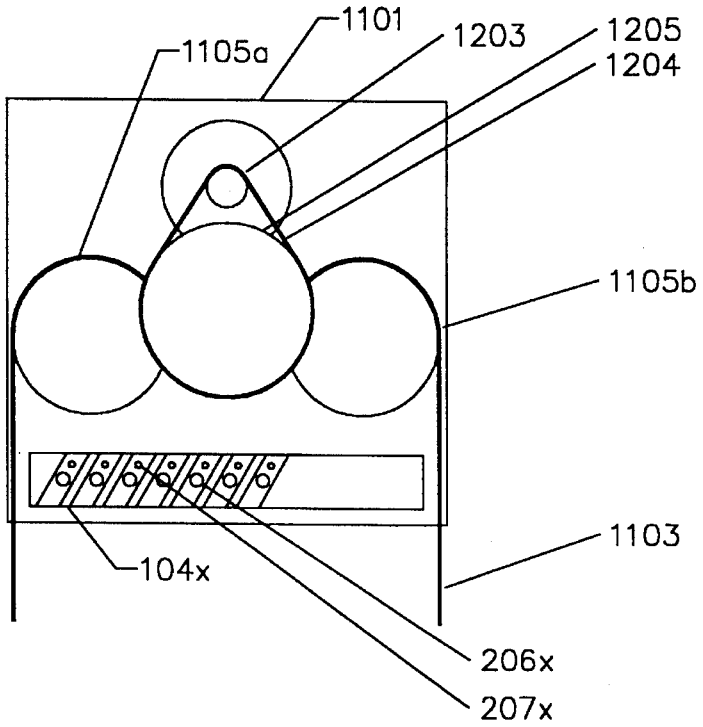
Figure 9B:
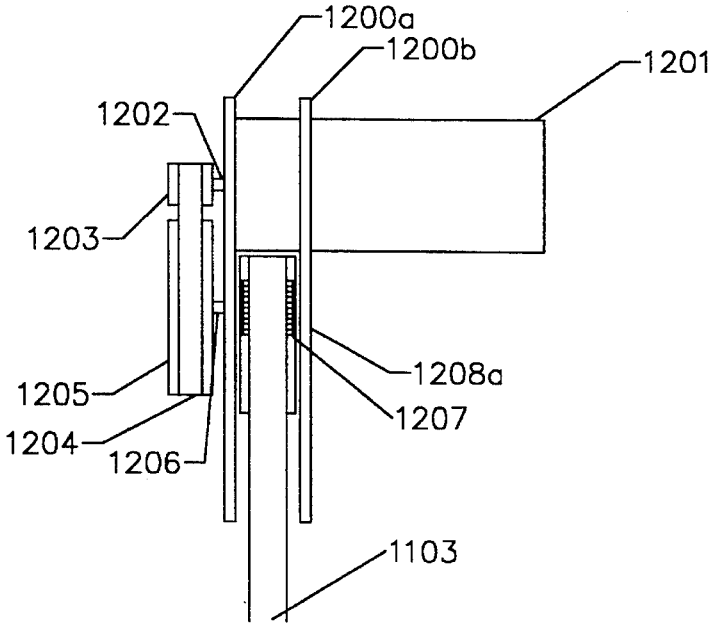

FIGS. *6a* through *6e*, collectively referred to herein as FIG. 6, constitute a flow chart showing the operation of the eccentric force control cable drive motor control loop of said CPU;

FIG. 7 is a graph showing the relationship between weight stack speed and eccentric force control cable drive motor torque for each of the six available control panel settings;

FIG. 8 is a front isometric view of a weight stack type exercise machine incorporating an attachment according to a second preferred embodiment of the present invention;

FIG. 9A is an isometric view of the drive assembly and control panel of the attachment incorporated in the machine of FIG. 8; and FIG. 9B is a side elevation view of the drive assembly shown in FIG. 9A.

FIGS. 9A and 9B are sometimes hereafter collectively referred to as FIG. 9.

GENERAL DESCRIPTION

According to one embodiment of the present invention an attachment for a weight stack type exercise machine has an electric motor and a control unit including a keypad, a display and a controller including a CPU. The motor is coupled to the weight stack by cable means which may comprise a lower eccentric force control cable and an upper eccentric force control cable.

The keypad allows the user to select the amount of force added during the eccentric phase of exercise, when the weight stack is moving down and part of a lifting cable connected to a handle or engageable member on the weight stack type machine is moving back into the machine.

A sensor coupled to the motor supplies a position signal to the controller, which determines whether the weight stack is moving up or down, and how fast it is doing so.

As the weights in the stack are being raised, no significant force is generated by the motor and eccentric force control cables.

As the weights are being lowered, an amount of additional (i.e. in addition to gravity) eccentric force which was selected by the user via the keypad is applied to the weight stack by the motor via the lower eccentric force control cable.

According to another aspect of the invention, if desired the controller may cause a specified upward force, which may in one embodiment be set by the user, to be applied to effectively decrease the weight of the weight stack when the weight stack is moving upward.

As herein described, according to another embodiment of the invention an attachment for a weight stack type exercise machine has an electric motor and a control unit including a keypad, a display and a controller including a central processing unit ("CPU"). Lifting means which comprises a toothed belt connects an exercise member such as a handle, bar or lever to the weight stack. The motor is coupled to the belt by means of a gear having teeth which engage the teeth of the belt. This embodiment operates in a manner similar to the first-mentioned embodiment, except that whereas in the first-mentioned embodiment the eccentric force is applied to the weight stack, pulling it down, in the latter embodiment the eccentric force is applied by applying force to the toothed belt in a direction to add to the force applied to the toothed belt by the weight stack as it moves down.

As the weights in the stack are being raised, no significant torque is generated by the motor.

As the weights are being lowered, an amount of additional (i.e. in addition to gravity) eccentric force as selected by the user via the keypad is applied to the lifting means by the motor via the gear and toothed belt; the amount of additional eccentric force being proportional to the torque generated by the motor.

DETAILED DESCRIPTION

Mechanical Structure

Cable Column

Figure 1:
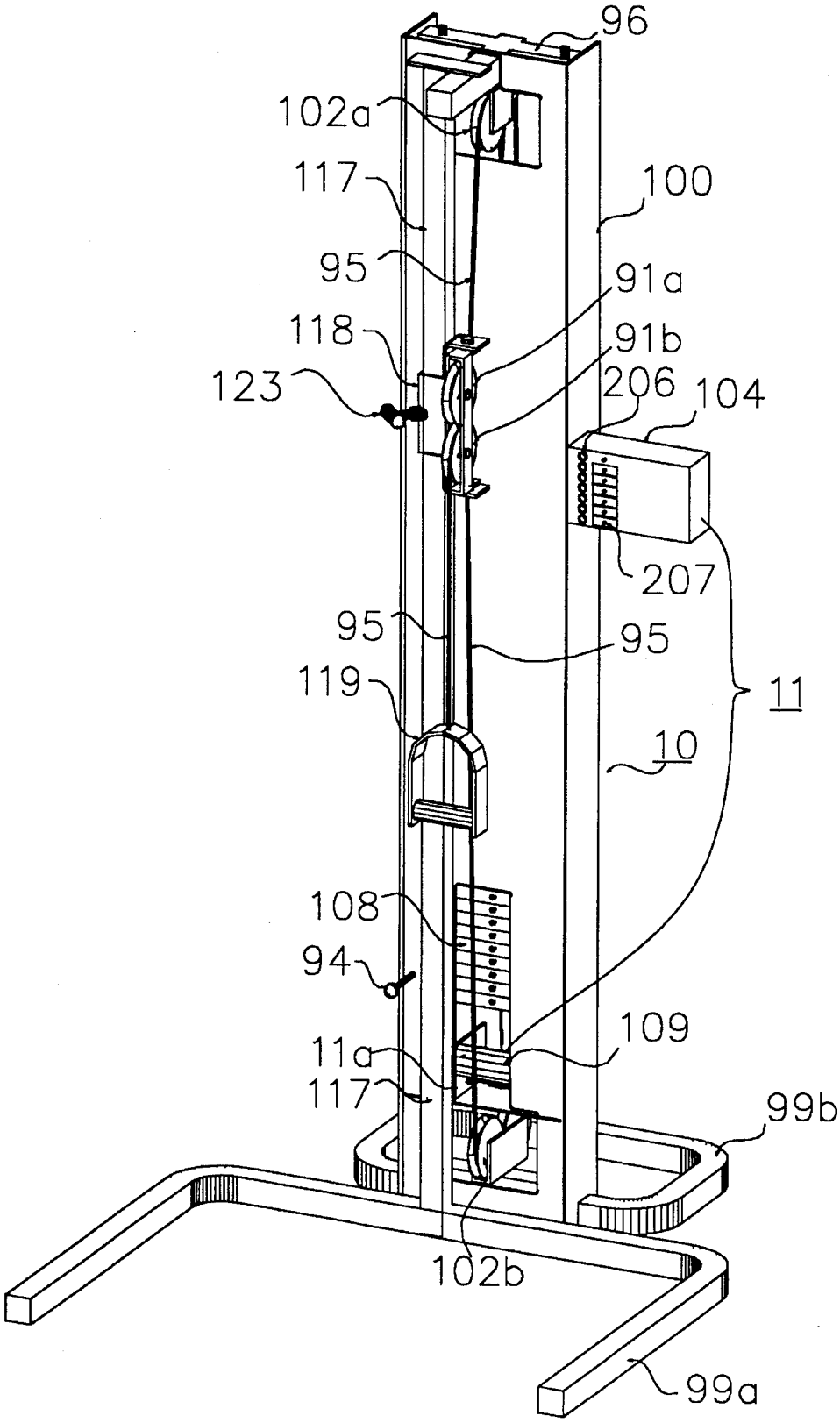
FIG. 1 is a front isometric view of a weight stack type exercise machine incorporating an attachment according to a first preferred embodiment of the present invention.
Figure 2:
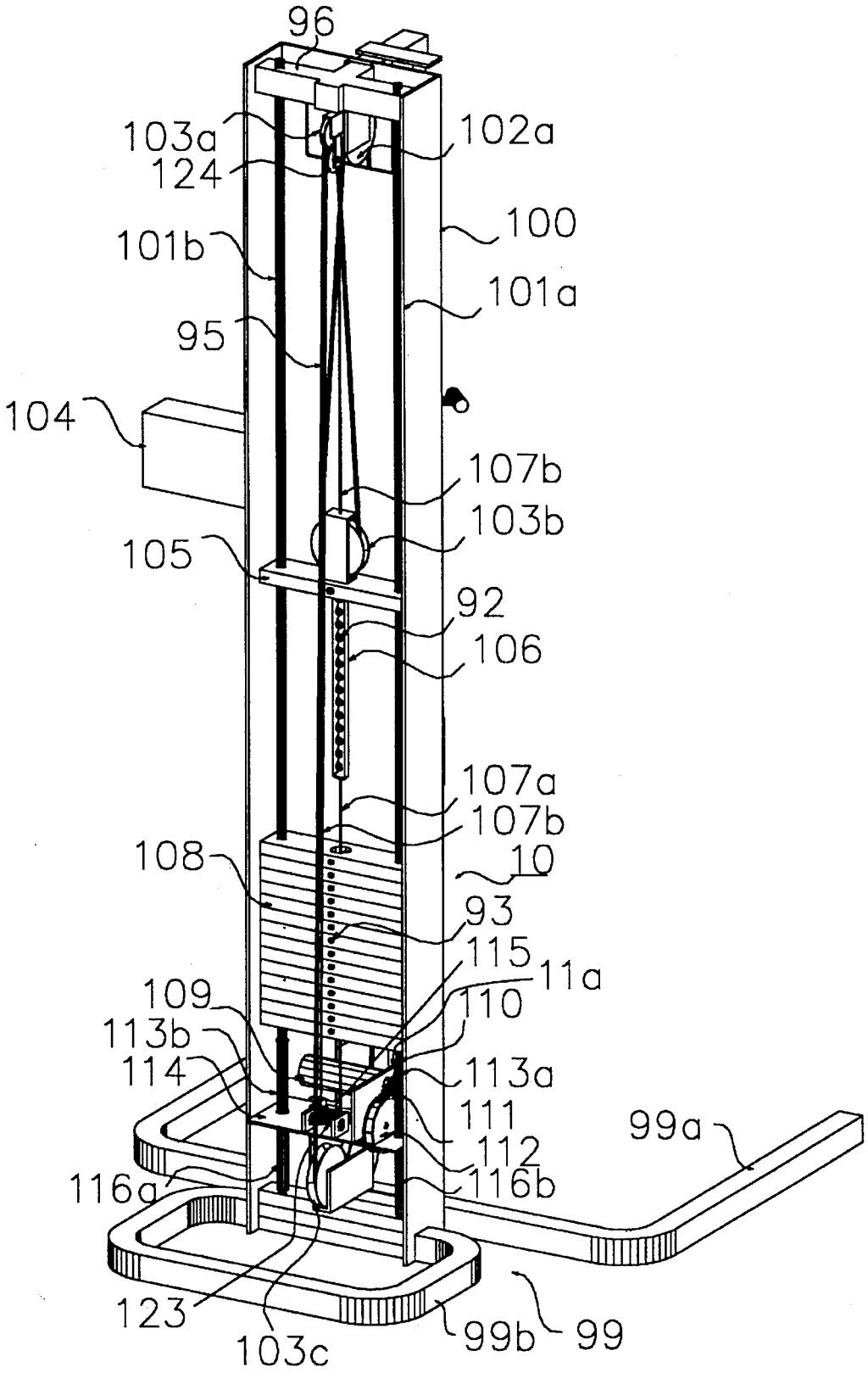
FIG. 2 is a rear isometric view of the machine of FIG. 1.
Figure 2A:
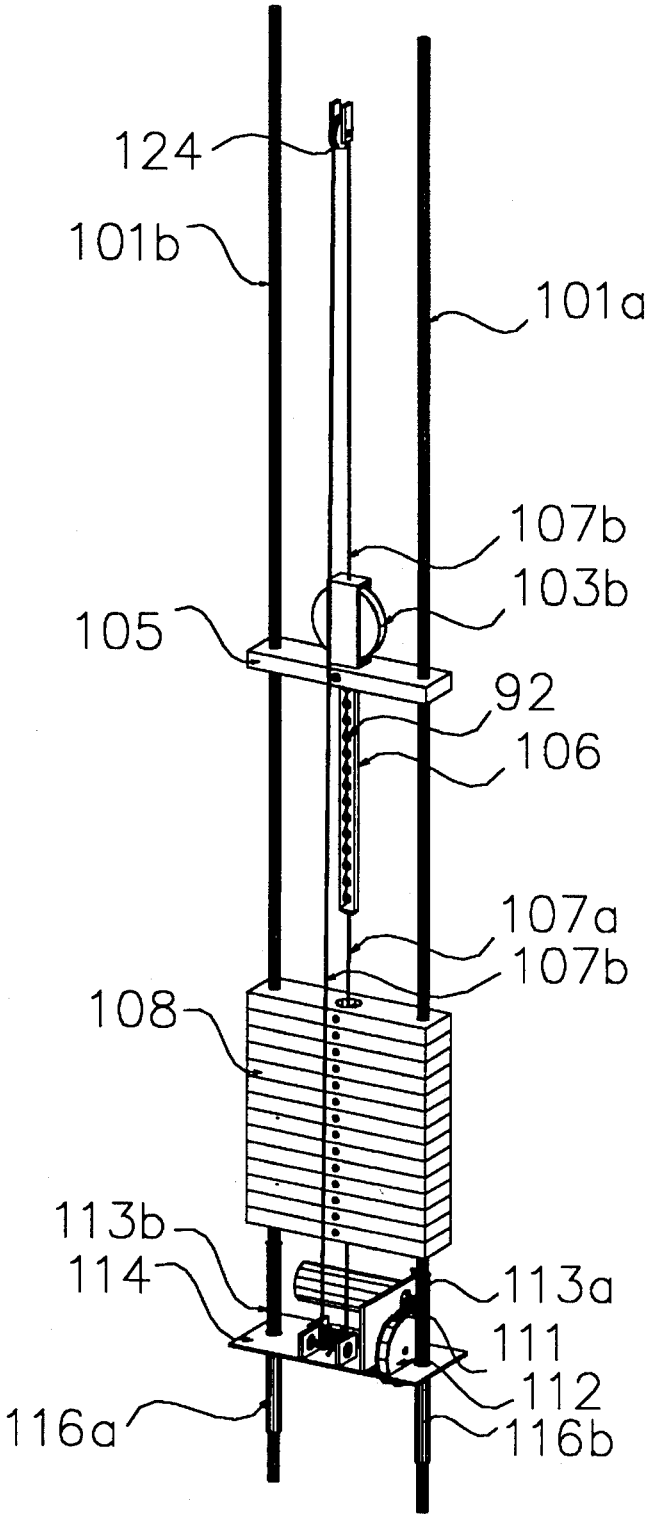
FIG. 2A is a rear isometric view of the portion of said machine comprising the weight stack, guide rods, and force control cable assembly.
Figure 4:
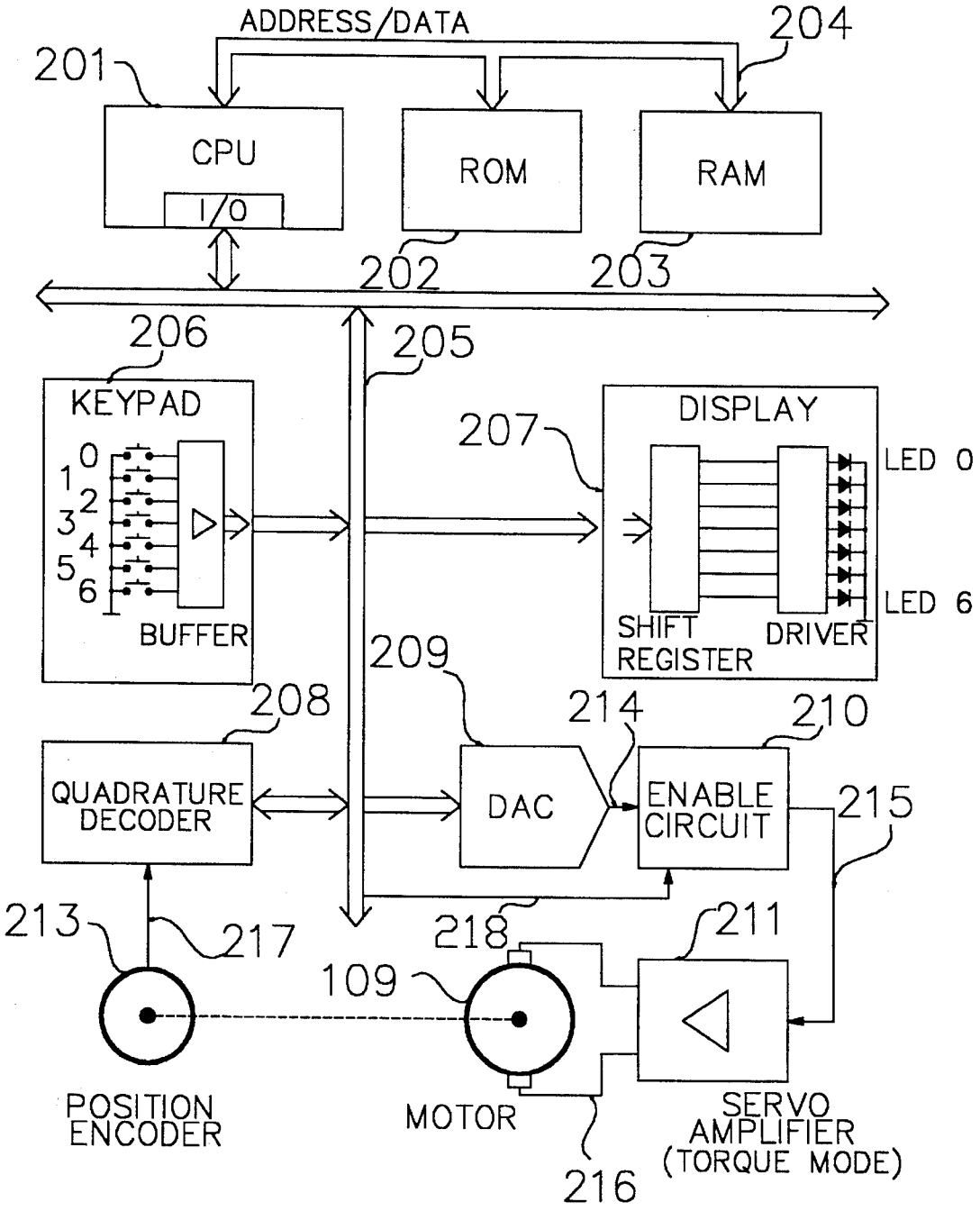
FIG. 4 is a functional electrical-mechanical block diagram of said attachment.

FIGS. 1 and 2 show a conventional weight stack type exercise machine 10 which has been fitted with an attachment 11 consisting primarily of (i) a motor and eccentric force control cable drive assembly 11*a*, (ii) a controller unit 104 housing [see FIG. 4] a keypad 206, display 207 and CPU 201 with associated electronic circuitry, (iii) a lower eccentric force control cable 107*a*, (iv) an upper eccentric force control cable 107*b*, (v) a spool 115 to which the cables are attached, and (vi) a pair of pulleys 123 and 124 which guide the upper eccentric force control cable 107*b* from the spool 115 to the top of the weight stack.

The exercise machine 10 has a vertically elongated protective shroud 100 which surrounds a pair of parallel vertical guide rods 101*a* and 101*b* along which the weight stack 108 moves, the guide rods extending through lateral vertically aligned holes in the weights of the stack 108. The shroud and guide rods are mounted on a base 99 having a forward extending portion 99*a* and a rearwardly extending portion 99*b*.

Tubular spacers 113*a* and 113*b* surround lower portions of the guide rods 101*a* and 101*b* respectively, so that the upper ends of the spacers may engage the lowest weight of the stack and thereby prevent the weight stack from striking the eccentric force control system 109. The lower ends of the spacers rest on the eccentric force control cable drive assembly main support plate 114.

When it is not resting on the spacers 113*a* and 113*b*, the weight stack 108 is supported by a selector bar 106 which depends from a vertically moveable lower cross member 105 having holes through which the guide rods 101*a* and 101*b* extend. A lower weight stack support pulley 103*b* is mounted to the upper surface of the cross member 105, while an upper weight stack support pulley 103*a* is mounted to an upper cross member 96 which is connected to the rods 101*a* and 10l*b* adjacent the upper ends thereof.

The selector bar 106 has a set of holes corresponding to each plate in the weight stack, so that the user may select the amount of weight to be lifted by bringing the lower cross member 105 down so it rests atop the weight stack, inserting the selector pin 94 into the selector hole 93 through the front of a corresponding weight plate, and pushing the pin into the selector hole so that the pin engages a corresponding hole 92 of the selector bar 106.

A weight stack lifting cable 95 has one end secured to a handle 119. The lifting cable 95 traverses guide pulleys 91*a* and 91*b* which are mounted to vertically adjustable carriage 118, goes around upper support pulley 102*a*, around lower support pulley 103*b*, around auxiliary upper support pulley 103*a*, around rear lower idler pulley 103*c*, and around front lower idler pulley 102*b*; and has its other end secured to the carriage bottom 118. The carriage can be placed at varying heights along a riser bar 117 secured to the frame 96.

A lower eccentric force control cable 107*a* is connected to the lower end of the weight stack selector bar 106, while the other end of the control cable 107*a* is fixed to the motor spool 115. An upper eccentric force control cable 107*b* is connected to the top of the weight stack pulley 103*b*, while the other end of the cable 107*b* is connected to the motor spool 115. Between its ends, the upper eccentric force control cable is routed around pulleys 123 and 124.

The pair of eccentric force control cables 107*a* and 107*b* effectively forms a loop between the top and bottom of the weight stack, which loop is driven by the motor spool 115.

Instead of the lower and upper eccentric force control cables, a single eccentric force control cable may be employed. Such a cable should be connected in a partial loop between the top and bottom of the selector bar 106, and driven by a friction drive at the motor spool, i.e. by routing the single cable between the spool and a capstan which is urged against the spool by a spring. In such an alternative arrangement, one end of the single eccentric force control cable is connected to the lower end of the weight stack selector bar 106, while the other end of that cable is connected to the top of the non-rotating frame of the lower support pulley 103*b*. Between its ends, the single eccentric force control cable is routed around the pulleys 123 and 124 to form a partial loop. An idler pulley may preferably be urged against said single cable by a spring and idler arm, so as to maintain tension in the control cable partial loop. Instead of a friction drive for the partial loop, a positive drive may be employed by use of a toothed belt for the partial loop, and a spool having a mating sprocket surface to drive the toothed belt.

Exercise may be performed by pulling down on the handle 119, thus applying concentric force to raise the weight stack; the vertical position of the carriage 118 on the riser bar 117 being adjustable by means of the thumbscrew 123 to suit the height and preference of the user.

As the weight stack is gradually lowered by allowing the handle 119 to rise, the eccentric force control cable drive assembly 11*a* causes the eccentric force control cable 107 to move so as to apply additional eccentric force pulling the weight stack down.

Motor Assembly

Figure 3:
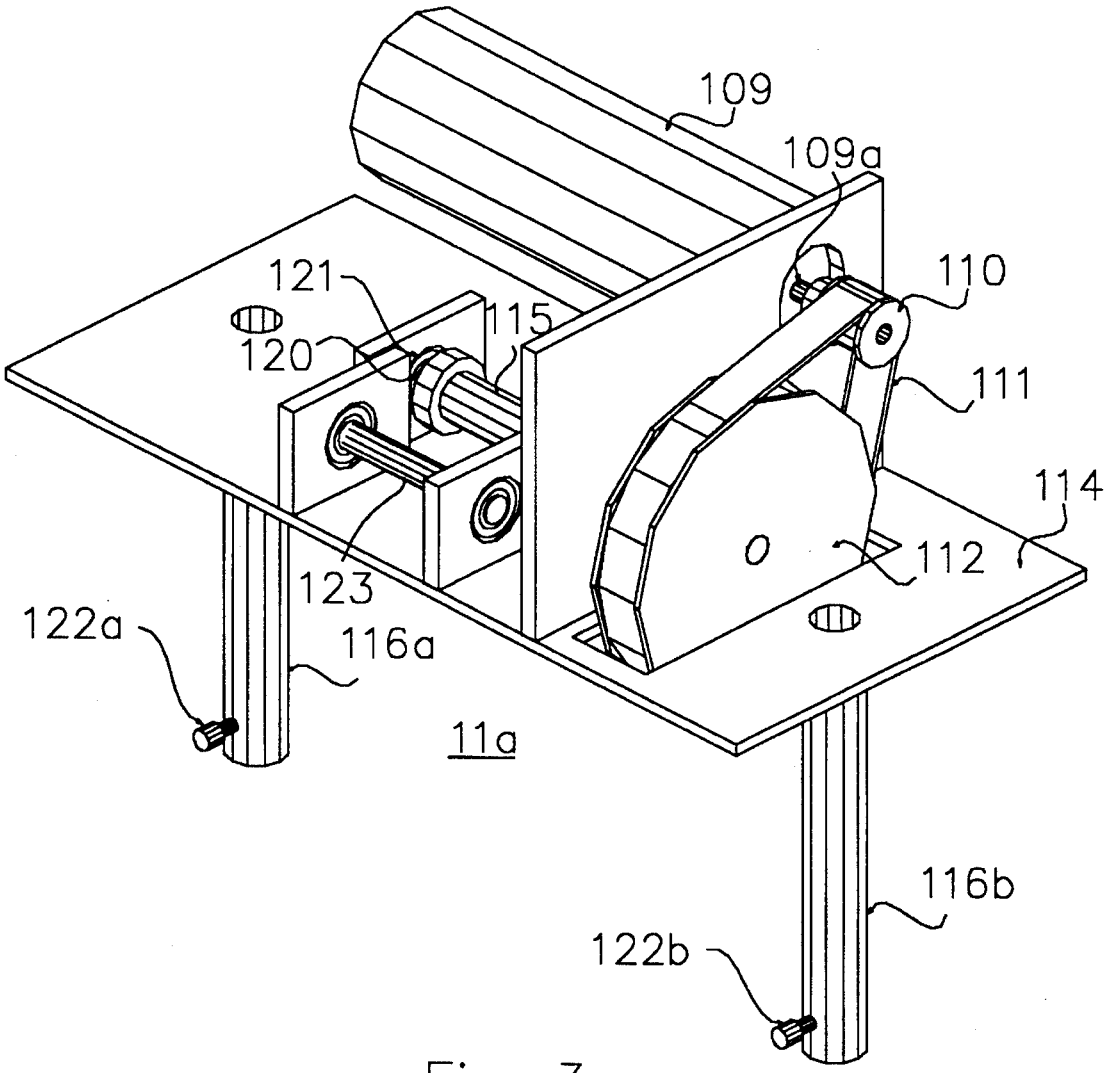
FIG. 3 is an isometric view of the drum assembly of the attachment incorporated in said machine.

As shown in FIG. 3, the eccentric force control cable drive assembly 11*a* has a main support plate 114 atop a pair of supporting tubes 116*a*, 116*b*. The assembly 11*a* is positioned below the weight stack 108 at the base of the cable column, with the guide rods 101*a* and 101*b* passing through the support tubes 116*b* and 116*a* respectively. The assembly is secured in place on the guide rods by means of screws 122*a* and 122*b* in the supporting tubes 116*a* and 116*b* respectively.

A DC motor 109 has a rotatable shaft 109*a* on which a relatively small diameter pulley 110 is mounted. When the motor is energized by supplying DC current thereto, a corresponding torque is applied, via pulley 110, drive belt 111 and relatively large pulley 112, to rotate the eccentric force control cable drive shaft 120 and spool 115. A pair of bearings 121 (only one of which is shown) supports the control cable drive pulley shaft.

The amount of current supplied to drive the DC motor 109 is determined by the desired additional eccentric force as selected by the user via the keypad 206 (FIG. 4), the torque generated by the motor being approximately proportional to said current over a substantial range.

Equation 1 shows the relationship between the motor torque and the additional eccentric force applied to the selection bar 106 by the eccentric force control cable 107, with the effects of friction in the motor, pulleys, etc. neglected.

$$F_{Bar} = \frac{1}{R_{Spool}} * \frac{R_{LargePulley}}{R_{SmallPulley}} * T_{Motor} \quad (1)$$

where $F_{Bar}$ is the force applied to the selection bar by the eccentric force control cable 107.

$R_{Spool}$ is the radius of the winding spool.

$R_{Large\ Pulley}$ is the radius of the larger pulley.

$R_{Small\ Pulley}$ is the radius of the smaller pulley.

$T_{Motor}$ is the motor torque.

For the preferred embodiment herein described, particular values of the above parameters are:

$R_{spool}$=0.315 in.

$R_{Large\ Pulley}$=3.8 in.

$R_{small\ Pulley}$=0.75 in.

$T_{Motor}$=50 oz.-in.

Therefore the maximum additional force which can be added by the motor arrangement in this example is $F_{Max}$=50 Lb. In the preferred embodiment this corresponds to a force equal to the weight of approximately three additional plates of the weight stack, which has a total of 14 plates. That is, at the maximum eccentric force setting of the keypad 206, when the weight stack 108 is being lowered, the force pulling the handle 119 back in is equal to the force that would be applied if the weight stack had three more plates in it when being lowered, than were in it when the stack was raised.

Mechanical Structure

Chest Press

The exercise machine 1100 shown in FIG. 8 functions in a similar manner to the machine 10, except for the differences hereafter described. Similar parts of the machine 1100 bear the same numerals as corresponding parts of the machine 10, followed by the suffix "x".

The machine 10 utilizes a cable to couple the weight stack to the user input handle, a pair of eccentric control cables to provide the increased forces, and a separate controller unit 104 which includes the keypad 206, display 207 and CPU 201.

As originally manufactured, the machine 1100 utilizes a flat belt to couple the weight stack to the user input handle. The flat belt is replaced by a toothed belt which is driven directly by the unit 1101 to provide the increased forces. In addition, the keypad 206, display 207 and CPU 201 which reside in the controller unit 104 of the machine 10, have been integrated directly into the motor unit 1101 in machine 1100.

The machine 1100 has been fitted with an attachment 1101 consisting primarily of (i) a motor and eccentric force control drive assembly 1102, (ii) a controller unit 104 housing a keypad pad 206, display 207 and CPU 201 with associated electronic circuitry, and (iii) a toothed drive belt 1103 connecting the lifting means to the weight stack.

Lifting means comprising a weight stack lifting belt 1103 has one end secured to the weight stack lower cross member 105 and the other end secured to a handle 1104 which is pivotally mounted to the frame at the lower end of the handle. The lifting cable traverses the control drive assembly 1102, drive gear 1207 and a pair of upper weight stack support pulleys 1105*a* and 1105*b*.

Exercise may be performed by pushing out on the handle 1104, thus applying concentric force to raise the weight stack.

As the weight stack is gradually lowered by allowing the handle 1104 to return at the end of, or in the course of an exercise stroke, the eccentric force control drive assembly 1102 causes the gear 1207 to rotate so as to apply additional eccentric force to add to the force applied to the belt 1103 by the weight stack; thus increasing the effective weight of the weight stack as felt by the person using the machine 1100.

Motor Assembly

As shown in FIG. 9, the eccentric force control drive assembly 1102 has a pair of support plates 1200*a* and 1200*b*, and a DC motor 1201 with a rotatable shaft 1202 on which a relatively small diameter pulley 1203 is mounted. When the motor is energized by supplying DC current thereto, a corresponding torque is applied, via small pulley 1203, drive belt 1204 and relatively large pulley 1205, to rotate the eccentric force control drive shaft 1206 and gear 1207. A pair of bearings 1208*a* and 1208*b* (only one of which is shown) supports the lifting means drive gear shaft 1206.

The amount of current supplied to drive the DC motor 1201 is determined by the desired additional or incremental eccentric force, as selected by the user via the keypad 206, the torque generated by the motor being approximately proportional to said current over a substantial range.

Electronic Controller

Microcontroller Circuit—FIG. 3

The microcontroller circuit consists of the CPU 201, a Read Only Memory (ROM) 202, and a Random Access Memory (RAM) 203, said components being interconnected via the Address/Data Bus 204.

Position Signal

The motor shaft 109*a* has a position encoder 213 coupled thereto. Motor position data in the form of a quadrature digitally encoded signal is coupled from the encoder 213 to the quadrature decoder 208 via line 217.

The decoder 208 contains a state monitor and output register which converts the quadrature signal to a position number, which is output to the input-output bus 205 of the CPU 201.

Motor Control Circuitry

The motor control circuitry includes a Digital to Analog Converter (DAC) 209 which receives commands from the CPU 201 via bus 205. An enable circuit 210 receives the analog output signal of DAC 209 on line 214 and selectively couples the analog output signal to the servo amplifier 211 in response to an enable signal from the microprocessor 201/202/203 on line 218, so as to prevent the motor from running before the CPU 201 is initialized. The output control signal voltage of the enable circuit 210 is fed via line 215 to the servo amplifier 211, which converts this control signal to the necessary motor drive signal; which motor drive signal is coupled to the motor 109 via line 216.

Control Panel

Figure 1A:
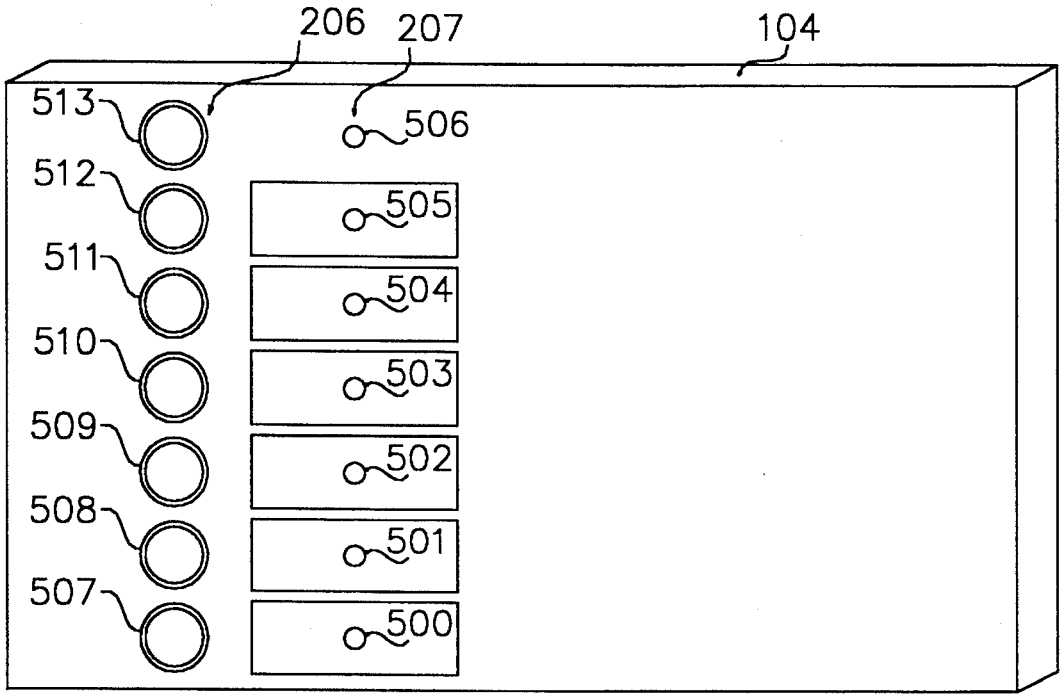
FIG. 1A is a front view of the control panel of the controller unit included in FIG. 1.

As shown in FIGS. 1, 1A and 4, the control panel on the front surface of the controller unit 104 has a keypad 206 with seven pushbuttons 507 to 513, and a display 207 with seven corresponding light emitting diodes (LEDs) 500 to 506.

Software

Startup Procedure

Figure 5:
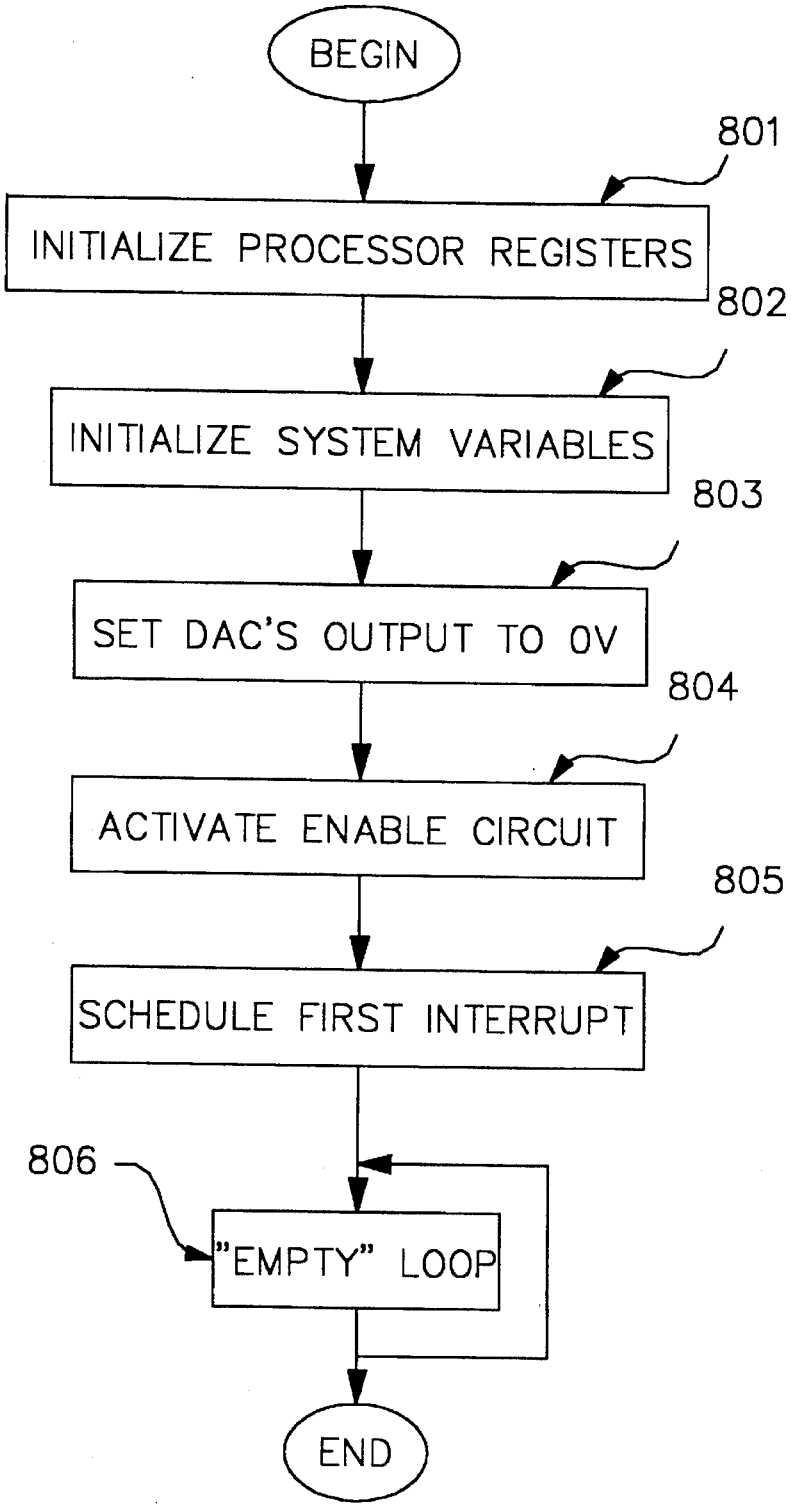
FIG. 5 is a high level flow chart showing the initialization of the central processing unit ("CPU") of said attachment.

As shown in FIG. 5, when the equipment shown in FIG. 4 is turned on, at Step 801 a startup procedure initializes the internal registers of the CPU 201. At Step 802 the system variables of the exercise machine eccentric force control program are initialized. At Step 803 the output voltage of the DAC 209 is set to zero. At Step 804 the enable circuit 210 is activated. At Step 805 the CPU 201 schedules the first interrupt. At Step 806 the program enters an "empty" loop where it waits for the interrupts to arrive.

Motor and Keypad Control Procedure

Text Description of Control Algorithm

FIG. 7 shows the torque TRQCMD generated by the drive motor. The system has three sets of "steady state" torque values, $TRQ_{UP}$, $TRQ_{STOP}$ and $TRQ_{0\ldots6}$.

As the weight is being lifted (positive speed), the value of TRQCMD is set to $TRQ_{UP}$ to minimize any friction in the motor from being presented to the user through the eccentric force control means. Since a force feedback signal is not available, $TRQ_{UP}$ is set just below the measured motor friction torque. Thus, as the weight stack is being raised, the controller helps overcome the motor friction in the direction of the rising weight stack.

At zero speed the controller sets the drive motor torque command to $TRQ_{STOP}$, wherein the magnitude of $TRQ_{STOP}$ is greater than the motor friction. This serves to insure that the motor begins to move the moment the user starts to lower the weight stack.

As the weight stack is being lowered, the controller sets the drive motor torque to $TRQ_{0\ldots6}$, corresponding to the additional eccentric weight value (0 through 6) selected on the keypad 206.

There are four possible transitions between the steady state torque values, shown as A, B, C, and D. The values $SPD_{UP}$ and $SPD_{DOWN}$, which define the limits of $TRQ_{UP}$, $TRQ_{STOP}$ and $TRQ_{0\ldots6}$ are set below the typical slowest continuous exercise speed.

Equations in Control Algorithm

Upon initialization the value of the TRQCMD is set to $TRQ_{STOP}$. Assume the weight stack is resting at the bottom of its travel. The moment the user starts to pull the lifting cable and the weight stack begins to move upward, the controller senses that movement. If the speed of the weight stack exceeds $SPD_{UP}$ (FIG. 7, section A) the value of TRQCMD is updated according to Equation 2.

$$TRQCMD(t) = TRQCMD(t_t) + k_{UP}\int_{t_t}^{t} \text{speed}(t)dt \qquad (2)$$

$$t > t_t$$

where $t_t$ is the time the weight stack speed became greater than $SPD_{UP}$.

The controller uses Equation 3 to generate the torque control signal.

$$TRQCMD_{n+1}=TRQCMD_n+k_{UP}*\text{speed}_n \qquad (3)$$

where $k_{UP}$ (the integration constant) controls how quickly the value of TRQCMD changes.

The greater $k_{UP}$, the faster the transition between steady-state torque values occurs. The value of TRQCMD is tested by the program and limited so that it is never set greater than $TRQ_{UP}$.

The user now approaches the top of his exercise range and the weight stack begins to slow down. When the speed of the weight stack decreases below $SPD_{UP}$, (FIG. 7, Section B) the value of the TRQCMD is updated according to Equation 4.

$$TRQCMD(t) = TRQCMD(t_t) + k_{UP}\int_{t_t}^{t} dt \qquad (4)$$

$$t > t_t$$

where $t_t$ is the time when the weight stack speed becomes less than $SPD_{UP}$, and $k_{UP}$, the constant of integration, is negative for TRQCMD greater than $TRQ_{STOP}$.

Under this condition the controller determines the value of TRQCMD in accordance with Equation 5.

$$TRQCMD_{n+1}=TRQCMD_n-\Delta TRQCMD_{DOWN} \qquad (5)$$

The constant $\Delta TRQCMD_{DOWN}$ is calculated in such a way that the controller changes the value of the TRQCMD from $TRQ_{UP}$ to $TRQ_{STOP}$ in some given, pre-specified time.

The user then begins to lower the weight stack. When the weights are moving downward at a speed faster than $SPD_{DOWN}$ (i.e. $|Speed|>|SPD_{DOWN}|$) (FIG. 7, Section C), the value of the TRQCMD is updated according to Equation 6.

$$TRQCMD(t) = TRQCMD(t_t) + k_{DOWN}\int_{t_t}^{t} \text{speed}(t)dt \quad (6)$$

$$t > t_t$$

where $t_t$ is the time the magnitude of the weight stack speed became greater than $|SPD_{UP}|$.

Under this condition the controller determines the value of TRQCMD in accordance with Equation 7.

$$TRQCMD_{n+1}=TRQCMD_n+k_{DOWN}*\text{speed}_n \quad (7)$$

where $k_{DOWN}$ is a variable which depends on the currently selected eccentric torque.

The values of $k_{DOWN}$ were selected so that given the same speed vs. time profile, TRQCMD will change from $TRQ_{STOP}$ to any value of $TRQ_n$ in the same amount of time.

The user now approaches the bottom of his exercise range and the weight stack begins to slow down. When the magnitude of the weight stack speed decreases below the magnitude of $SPD_{DOWN}$, (FIG. 7, Section D) the value of the TRQCMD is updated according to Equation 8.

$$TRQCMD(t) = TRQCMD(t_t) + k_{DOWN}\int_{t_t}^{t} dt \quad (8)$$

$$t > t_t$$

where $t_t$ is the time when the magnitude of the weight stack speed becomes less than $|SPD_{DOWN}|$, and $k_{DOWN}$, the constant of integration, is positive for TRQCMD less than $TRQ_{STOP}$.

Under this condition the controller determines the value of TRQCMD in accordance with Equation 9.

$$TRQCMD_{n+1}=TRQCMD_n+\Delta TRQCMD_{UP} \quad (9)$$

The value of the variable $\Delta TRQCMD_{UP}$ is set so that the TRQCMD ramps from all $TRQ_n$ values to $TRQ_{STOP}$ in the same amount of time (not necessarily in the same time as the transition from $TRQ_{UP}$ to $TRQ_{STOP}$).

It is important to note that the transitions described by A, B, C and D are shown as wavy lines. This is to illustrate the point that these transitions can occur at any point on FIG. 7. For example, the user may begin to raise the weight to initiate transition (A) and then start to reduce the speed to initiate transition (B) before the controller reaches $TRQ_{UP}$. The controller program deals with all such situations.

Detailed Description of Flow Chart

As shown in FIG. 6, at Step 901 the motor control part of the program schedules the next interrupt. At Step 902 the value contained in the internal position register of the quadrature decoder 213 is read. At Step 903 the absolute weight stack position is updated in accordance with Equation 10. Due to the dual eccentric cable arrangement [or the gear and belt arrangement, in the embodiment shown in FIGS. 8 and 9] coupling the motor to the weight stack, the system can determine the weight stack position from the initial weight stack position, initial motor rotational position and amount of motor rotation.

$$Pos[n]:=Pos[n-1]+(Decoder[n]-Decoder[n-1]) \quad (10)$$

At Step 904, the weight stack speed and acceleration values are updated from the position data, using Equations 11 and 12.

$$Speed[n]:=(Pos[n]-Pos[n-1])\Delta T \quad (11)$$

$$Accel[n]=(Speed[n]-Speed[n-1])/\Delta T \quad (12)$$

and a moving average procedure in accordance with Equation 13 filters the velocity and acceleration values.

$$X[n] = \frac{X[n] + x[n-1] + X[n-2] \ldots + X[n-k]}{k} \quad (13)$$

The filtering cancels the effects of a position artifact caused by the drive belt 111, mechanical imperfections and high frequency vibrations.

At Step 905 the program checks the sign of the motor speed, to determine whether the weight stack is moving up or down. Speeds greater than or equal to zero correspond to pulling the lifting cable 95, i.e. raising the weight stack. Speeds less than zero correspond to letting the handle 119 move up, i.e. lowering the weight stack.

If the motor speed is greater than or equal to zero, at Step 906 the program compares the motor speed to $SPD_{UP}$. If the speed is greater than $SPD_{UP}$, at Step 908 the value of TRQCMD is set in accordance with Equation 3.

At Step 922 the program compares the value of TRQCMD to $TRQ_{UP}$. If TRQCMD is greater than $TRQ_{UP}$, TRQCMD is set to $TRQ_{UP}$ at Step 921. This prevents the system from setting a value of TRQCMD greater than $TRQ_{UP}$.

At Step 912 the DAC command (value to be written to the DAC register) is updated in accordance with Equation 14.

$$DACCMD[n]=TRQCMD[n]+F1(SPD[n])+F2(ACC[n]) \quad (14)$$

where

F1 represents additional compensation for dynamic friction, and

F2 is the compensation designed to avoid the overshoot due to rotational inertia as well as to help the system accelerate and decelerate.

When the user pulls the lifting cable 95 very hard and then suddenly stops pulling, because of rotational inertia the motor 109 keeps running.

A particular motor/servo amplifier combination can be characterized by a maximum short term acceleration/deceleration rate. This is one of the factors limiting the ability of the microcontroller 201/202/203 to fully compensate for inertial effects.

One of the other important limiting factors is the nature of positive feedback; i.e. the system must remain stable. However, within a reasonable range of acceleration/deceleration rates expected to be encountered in normal use, the controller can provide satisfactory compensation for inertial effects.

At Step 909 the system compares the value of TRQCMD to $TRQ_{STOP}$. If TRQCMD is greater than $TRQ_{STOP}$, at Step 923 TRQCMD is set in accordance with Equation 5.

At Step 930, the system compares the value of TRQCMD to $TRQ_{STOP}$. If TRQCMD is less than $TRQ_{STOP}$, at Step 929 the TRQCMD is set to $TRQ_{STOP}$. The DACCMD is then updated at Step 912.

If the value of TRQCMD was less than or equal to $TRQ_{STOP}$ in Step 909, then at Step 924 the value of TRQCMD is set in accordance with Equation 9.

At Step 932, the system compares the value of TRQCMD to $TRQ_{STOP}$. If TRQCMD is greater than $TRQ_{STOP}$, TRQCMD is set to $TRQ_{STOP}$ at Step 931.

If the motor speed was less than zero in Step 905, the system compares the motor speed to $SPD_{DOWN}$ in Step 907. If the motor speed was less than $SPD_{DOWN}$, at Step 910 the system sets the TRQCMD in accordance with Equation 7.

At Step 926, the system compares the value of TRQCMD to the value $TRQ_n$ entered by the user on the keypad 206. If TRQCMD is less than $TRQ_n$, TRQCMD is set to $TRQ_n$ in Step 925. Thus as the weights are being lowered, the motor torque will not exceed the equivalent additional eccentric weight amount entered at the keypad when the speed is greater than $SPD_{DOWN}$.

At Step 913 the value of DACCMD is updated in accordance with Equation 15.

$$DACCMD[n]=TRQCMD[n]+F1(SPD[n])+F3(ACC[n]) \quad (15)$$

where

F1 represents additional compensation for dynamic friction, and

F3 is the compensation designed to avoid the overshoot due to rotational inertia as well as to help the system accelerate and decelerate.

If the motor speed was greater than or equal to $SPD_{DOWN}$ in Step 907, the system compares the TRQCMD to $TRQ_{STOP}$ at Step 911. If the TRQCMD is greater than $TRQ_{STOP}$, at Step 927 the system updates the value of TRQCMD in accordance with Equation 5.

At Step 934 the system compares the TRQCMD value to $TRQ_{STOP}$. If TRQCMD is less than $TRQ_{STOP}$, the system sets the value of TRQCMD to $TRQ_{STOP}$ in Step 933. The DACCMD is then updated at Step 913.

If the value of TRQCMD was less than or equal to $TRQ_{STOP}$ in Step 911, at Step 928 the system sets the value of TRQCMD in accordance with Equation 9.

At Step 936 the value of TRQCMD is compared to the $TRQ_{STOP}$. If TRQCMD is greater than $TRQ_{STOP}$, then TRQCMD is set to $TRQ_{STOP}$ at Step 935. The DACCMD is then updated at Step 913.

Four position constants are defined for the system, viz.:

(1) $POS_{HOME}$ is the system position value corresponding to the weight stack at the bottom of its travel.

(2) $POS_{DOWN}$ is derived from $POS_{HOME}$ by adding the distance corresponding to two inches of linear motion of the weight stack. These two initial inches of weight stack movement are treated differently by the controller 201/202/203, as this range is not considered to be part of the normal exercise range. Normal exercise is performed without the weights hitting the bottom of their travel. When the weights hit the bottom, the dynamic characteristics of the system change dramatically. The $POS_{DOWN}$ region is intended to be the safety range in case a user completely lets go of the lifting cable 95, which might lead to breakage of the eccentric force control means 107*a*.

The scenario of such an event for the machine 10 could be described as follows: The user lets go of the cable, and the weight stack accelerates rapidly downward. The drive motor begins to accelerate, but when the controller 201/202/203 senses the motor position below $POS_{DOWN}$, it enters a different algorithm using negative velocity feedback. Depending on the amount of weight currently selected, the system may not be able to prevent the weights from hitting the bottom, but it can attempt to reduce the motor speed so that when the weights hit bottom, the rotational energy stored in the motor/transmission assembly is reduced. This in turn reduces stresses in the eccentric force control cable 107*a*.

(3) $POS_{ERROR}$ is derived from $POS_{HOME}$ by subtracting the distance corresponding to two inches of the weight stack. Unless there is some erroneous reading, this position can only be reached when the eccentric force control cable 107*a* is broken and the motor turns freely.

(4) $POS_{UP}$ is derived from $POS_{HOME}$ by adding the distance corresponding to the normal linear range of motion of the weight stack. Unless an error occurs, the position determined by the control system should never exceed $POS_{UP}$.

At step 802, the position value variable POS[n] is set to $POS_{HOME}$.

At Step 914 the value of POS[n] is compared to $POS_{DOWN}$. If POS[n] is greater than $POS_{DOWN}$ the system compares POS[n] to $POS_{UP}$ at Step 915. At Step 915, if the value of POS[n] is not greater than $POS_{UP}$, then at Step 920 the program updates the DAC with a new value of DACCMD.

At Step 915, if the value of POS[n] is greater than $POS_{UP}$, the system enters the position error routine at Step 917, which disables the motor.

At Step 916, if the value of POS[n] is not greater than $POS_{ERROR}$, i.e. it appears the eccentric force control cable has broken, at Step 919 the DACCMD is set in accordance with Equation 16.

$$DACCMD[n]=-K*SPD[n] \quad (16)$$

At Step 916, if the value of POS[n] is greater than $POS_{ERROR}$, i.e. the weight stack is within two inches of $POS_{HOME}$, at Step 918 the value of DACCMD is set in accordance with Equation 17.

$$DACCMD[n]=TRQ_{BRAKE}-K*SPD[n] \quad (17)$$

where $TRQ_{BRAKE}$ is a torque applied to the motor, and

K is a constant of proportionality.

At Step 920 the program updates the value of DAC with a new value of DACCMD.

Figure 6A:
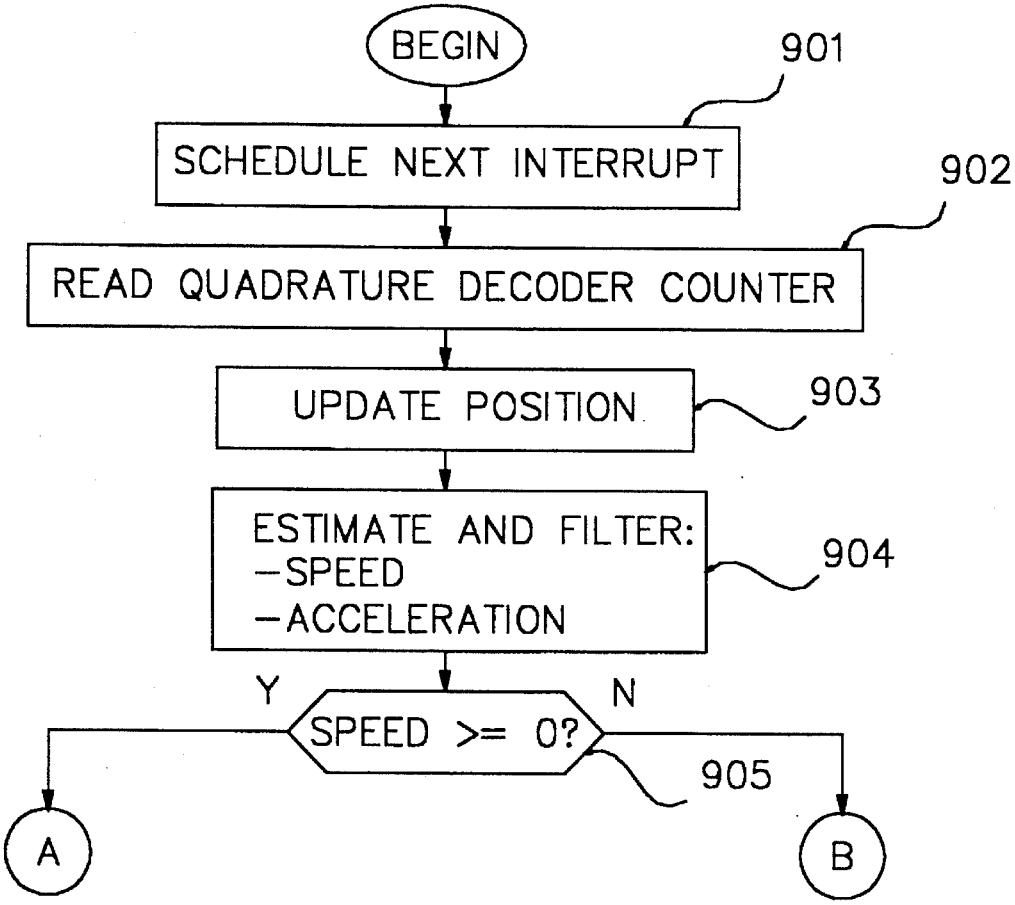
Figure 6B:
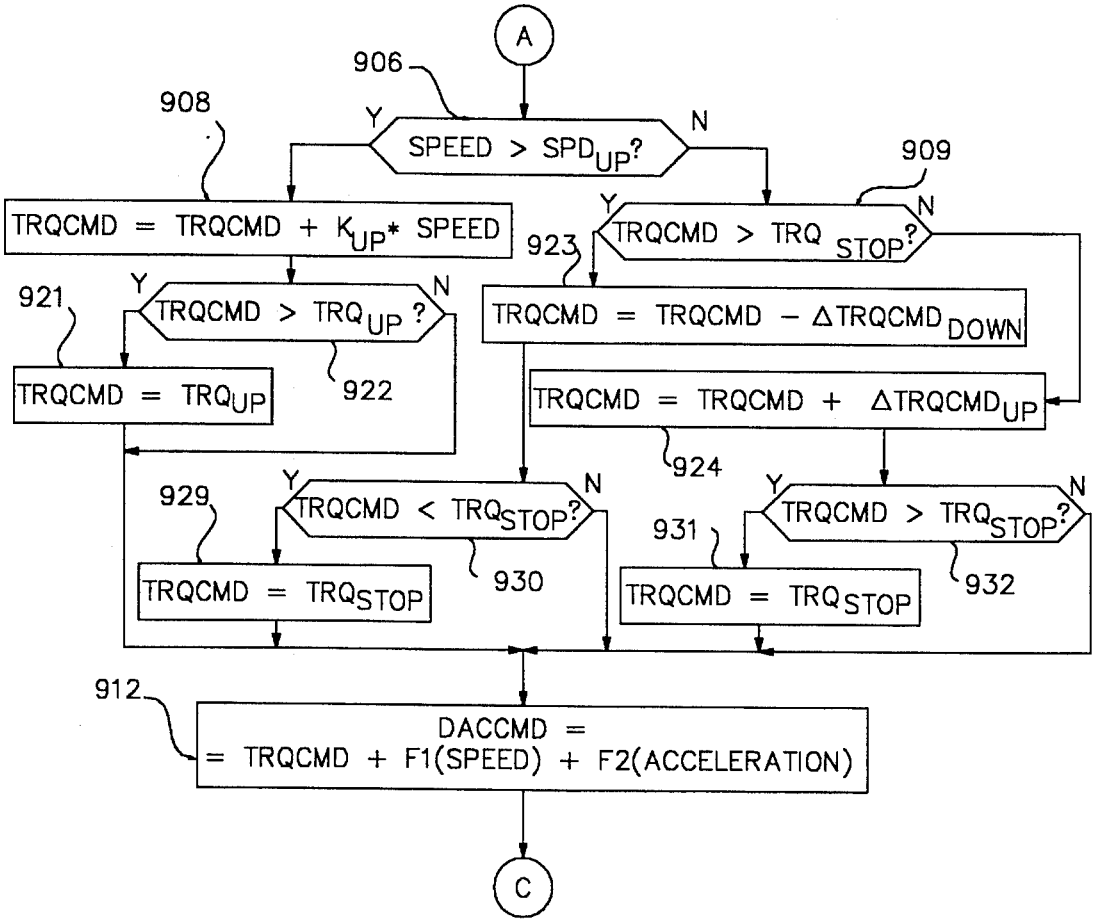
Figure 6C:
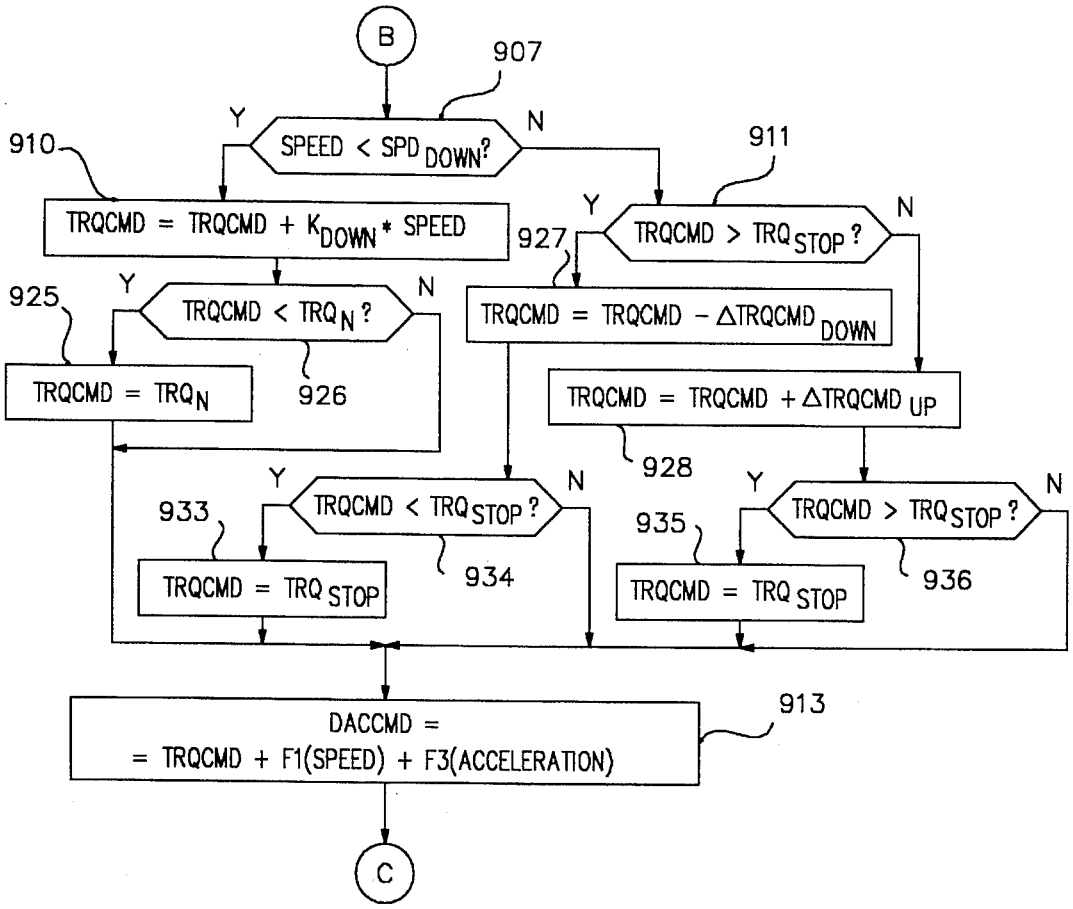
Figure 6D:
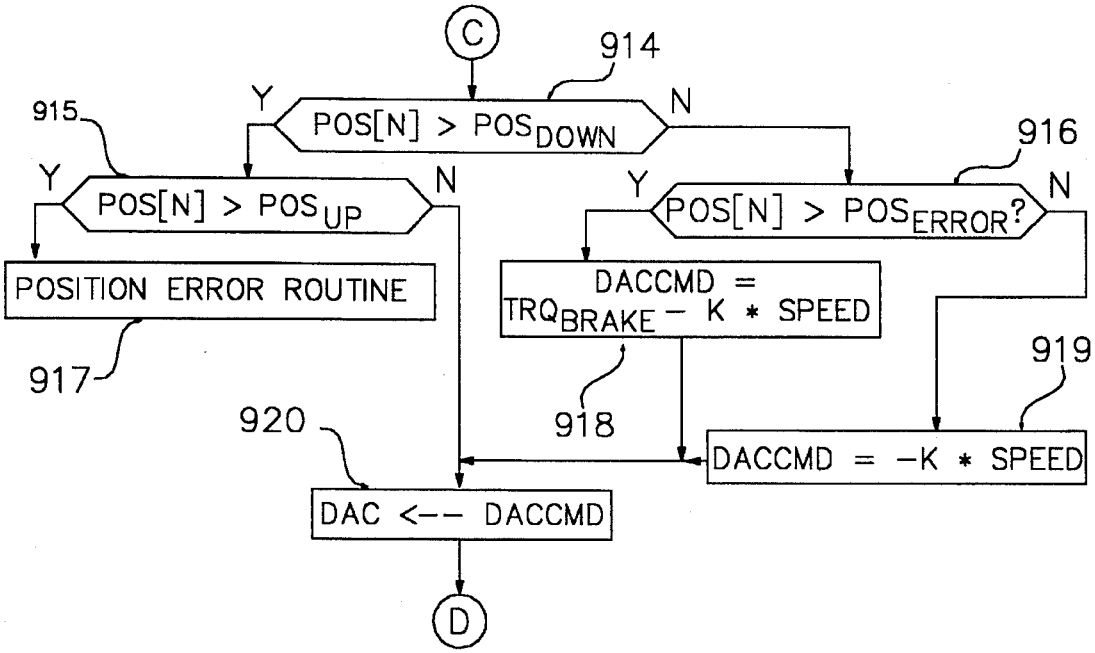
Figure 6E:
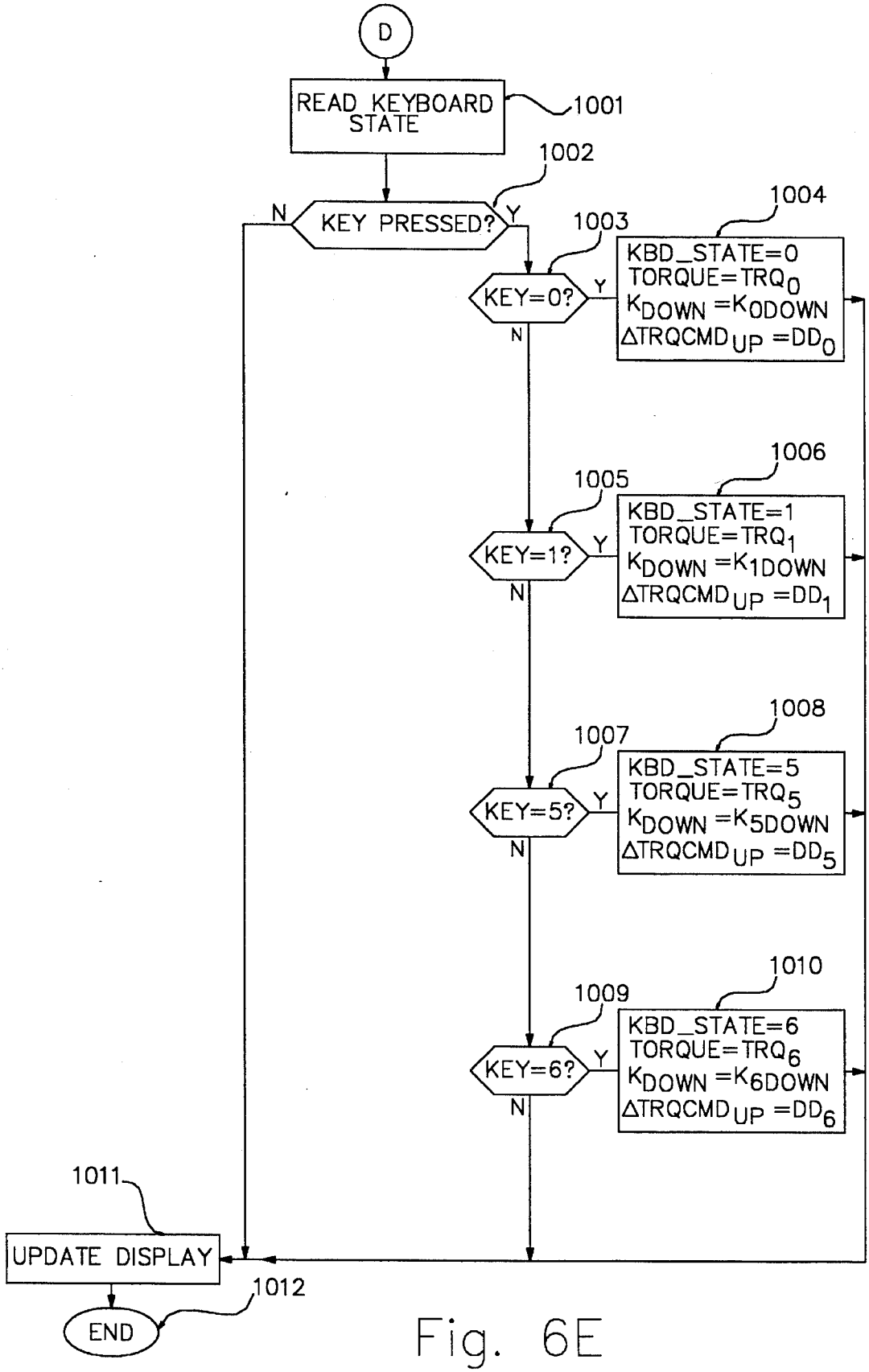

Next, as shown in FIG. 6*e*, at Step 1001 the keypad control procedure portion of the program reads the current state of the keypad 206. At Step 1002, if none of the keys are pressed, at Step 1011 the procedure updates the display 207 with the previous key value; and at Step 1012 the procedure exits.

If a key was pressed, at Steps 1003, 1005, 1007 and 1009 the procedure tests which key was pressed and at Steps 1004, 1006, 1008 and 1010 the procedure stores the appropriate torque value. For simplicity of the diagram, the flow chart does not show this routine for all of the keys.

The key test procedures are written such that if two keys are pressed simultaneously, no change is made to the torque setting.

The display update is arranged such that if key 513 is pressed for a zero value of additional eccentric force, only LED 506 is illuminated. If key 512 is pressed for an additional eccentric force corresponding to one-half more weight stack plate, LEDs 505 and 506 are illuminated. If key 511 is pressed for an additional eccentric force corresponding to one more weight stack plate, LEDs 504,505 and 506 are illuminated; and so forth. Thus the display 207 simulates the number of one-half plate equivalents added during eccentric exercise, in the same manner that placing the pin 94 in the weight selection bar selects all the weights above the pin.

OTHER EMBODIMENTS OF THE INVENTION

While the preferred embodiment has been described in terms of adding a fixed amount of (equivalent) weight in only the eccentric exercise direction of a weight stack type exercise machine, the eccentric force control means are capable of applying force to pull the weight stack up as well as to pull it down.

Thus the keyboard 206 may include a pushbutton arrangement for selectively increasing or decreasing the equivalent force added in the eccentric or concentric exercise direction; in which event the microprocessor 210/202/203 includes a corresponding procedure in its program, to drive the motor so as to exert force on the weight stack (or exert force on the cable or belt which couples the weight stack to an exercise member) during the corresponding part of an exercise.

The arrangement of the present invention is also capable of customizing an exercise by varying the amount of additional eccentric and/or concentric exercise force as a function of (i) the vertical position of the weight stack, (ii) the range of motion or stroke of the user, and/or (iii) the number of times the exercise has been repeated, i.e. the repetition number. These features are provided by including corresponding pushbuttons or other selection means on the keyboard 206, and corresponding procedures in the program of the microprocessor 201/202/203.

The number of repetitions can be counted by incrementing a counter in the RAM 203 each time the direction of movement of the weight stack changes from downward to upward.

The total amount of weight being lifted and the total amount of weight being lowered can be determined by the user inputting (via the keyboard) the number of plates selected by insertion of the pin 94.

By combining the amount of (actual) weight selected by the pin 94 with (i) the amount of (equivalent) weight added or subtracted (via the eccentric force control means) during eccentric exercise and (ii) any (equivalent) weight added or subtracted (via the eccentric force control means) during concentric exercise, and multiplying by the number of repetitions, the microprocessor 201/202/203 may generate information as to the total work done by the user in the course of the exercise. This information may be displayed on a continuous basis, on a display readout of the control panel on the front surface of the controller 104.

We claim:

1. In a weight stack type exercise machine having a weight stack and lifting means coupled to an exercise member for manually raising and lowering the stack, the improvement comprising:

a drive motor;

eccentric force control means coupled between said motor and said lifting means for applying a force to said lifting means which varies in accordance with the torque generated by said motor;

sensing means coupled to said lifting means for determining the magnitude and direction of the speed of said weight stack; and a microcontroller coupled to said sensing means and said motor for varying the torque generated by said motor in accordance with an eccentric force input signal and the output of said sensing means, to cause said eccentric force control means to apply a predetermined force to said lifting means corresponding to said eccentric force input signal when the stack is moving down, the direction of said predetermined force being such that said predetermined force adds to the force applied by said weight stack to said lifting means, the combined forces applied to said lifting means by said weight stack and said eccentric force control means being coupled to said exercise member by said lifting means.

2. The improvement according to claim 1, further comprising a keypad having selection means for generating said eccentric force input signal.

3. The improvement according to claim 1, further comprising display means for indicating the value of said eccentric force input signal.

4. The improvement according to claim 1, wherein said lifting means comprises a toothed belt, and said eccentric force control means comprises a rotatable gear having teeth engaging teeth of said belt.

5. The improvement according to claim 4, wherein said microcontroller causes said eccentric force control means to apply minimal force to said belt when the stack is moving up.

6. The improvement according to claim 4, wherein said microcontroller causes said motor to drive said gear so as to substantially compensate for drag effects due to said eccentric force control means and associated mechanical elements.

7. In a weight stack type exercise machine having a plurality of weight plates, a pair of parallel vertical guide rods for maintaining said plates in vertical alignment, selection/support means operatively associated with said guide rods for selecting and supporting a number of said plates to be included in a weight stack, lifting means for manually raising and lowering the selection/support means and weight stack, and an exercise member connected to a part of said lifting means remote from said weight stack, the improvement comprising:

a drive motor;

force incrementing means coupled to said motor for applying a force to said lifting means which varies in accordance with the torque generated by said motor;

sensing means coupled to said lifting means for determining the magnitude and direction of the speed of said weight stack; and a microcontroller coupled to said sensing means and said motor for varying the torque generated by said motor in accordance with an eccentric force input signal and the output of said sensing means, to cause said force incrementing means to apply a predetermined force to said lifting means corresponding to said eccentric force input signal only when the stack is moving down, the direction of said predetermined force being such that said predetermined force adds to the force applied by said weight stack to said lifting means, the combined forces applied to said lifting means by said weight stack and said force incrementing means being coupled to said exercise member by said lifting means.

8. The improvement according to claim 7, wherein said lifting means comprises a toothed belt, and said force incrementing means comprises a rotatable gear having teeth engaging teeth of said belt.

9. The improvement according to claim 8, wherein said microcontroller causes said motor to drive said gear so as to substantially compensate for drag effects due to said force incrementing means and associated mechanical elements.

10. The improvement according to claim 8, wherein said microcontroller causes said gear to apply force to said belt when said weight stack is moving down at a speed in excess of a predetermined speed limit, the direction of said force being opposite to the direction of movement of said belt.

11. The improvement according to claim 8, wherein said belt partially wraps around said gear so that several teeth of said gear and said belt simultaneously engage each other, and said force incrementing means comprises power transmission means coupled between said motor and said gear.

12. In a weight stack type exercise machine having a plurality of weight plates, a pair of parallel vertical guide rods for maintaining said plates in vertical alignment, a selector bar operatively associated with said guide rods for supporting a weight stack, means for coupling a selected number of said plates to be included in said weight stack to said selector bar, and lifting means for lifting said weight stack, said lifting means having one end connected to said selector bar and another end connected to an exercise member, the improvement comprising:

variable force incrementing means including an eccentric force drive motor and power transmission means operatively connected to said lifting means, for applying a force to said lifting means which varies in accordance with an eccentric force control signal;

sensing means for determining the magnitude and direction of the speed of said weight stack;

input means for generating an eccentric force input signal in response to manual actuation thereof;

means for indicating the selected magnitude of said eccentric force input signal; and a microcontroller coupled to said sensing means, said input means and said variable force incrementing means for generating said eccentric force control signal to cause said variable force incrementing means to apply (i) minimal force to said lifting means when the weight stack is moving up, and (ii) a predetermined force to said lifting means corresponding to said eccentric force input signal when the weight stack is moving down, the direction of said predetermined force being such that said predetermined force adds to the force applied by said weight stack to said lifting means, the combined forces applied to said lifting means by said weight stack and said variable force incrementing means being coupled to said exercise member by said lifting means.

13. The improvement according to claim 1, 7 or 12, wherein said microcontroller includes means for reversing the direction of the force applied to the lifting means by the motor when the weight stack is lowered at an excessive speed in a lower range of movement thereof, to slow down the rate of descent of the weight stack and thus minimize damage due to releasing of said exercise member when said weight stack is in a raised position.

14. An attachment in combination with a weight stack type exercise machine having a weight stack and lifting means for manually raising and lowering the stack, with an exercise member connected to a part of said lifting means remote from said weight stack, said attachment comprising:

variable force incrementing means including a drive motor and power transmission means operatively connected between said motor and said lifting means, for applying a force to said lifting means which varies in accordance with an eccentric force control signal;

sensing means for determining the magnitude and direction of the speed of said stack;

manually operable input means for generating an eccentric force input signal corresponding to a desired increment of eccentric force to be applied to said exercise member; and a microcontroller coupled to said sensing means and said variable force incrementing means for providing said eccentric force control signal to vary the force applied to said lifting means by said variable force incrementing means in accordance with said eccentric force input signal and the output of said sensing means, to cause application of a predetermined force to said lifting means corresponding to said eccentric force input signal only when the weight stack is moving in a given direction, the combined forces applied to said lifting means by said weight stack and said variable force incrementing means being coupled to said exercise member by said lifting means.

15. The combination according to claim 14, wherein said microcontroller causes said motor to be driven so that said variable force incrementing means applies minimal force to said lifting means when the weight stack is moving in a direction opposite to said given direction.

16. An attachment in combination with a weight stack type exercise machine having a plurality of weight plates, a pair of parallel vertical guide rods for maintaining said plates in vertical alignment, selection/support means operatively associated with said guide rods for selecting and supporting a number of said plates to be included in a weight stack, and a toothed belt for manually raising and lowering the selection/support means and weight stack, said attachment comprising:

a drive motor;

a rotatable gear having teeth engaging teeth of said belt;

mechanical power transmission means for coupling said motor to said gear to apply a force to said belt which varies in accordance with the torque generated by said motor;

sensing means coupled to said transmission means for determining the magnitude and direction of the speed of movement of a portion of said belt engaged by said transmission means; and a microcontroller coupled to said sensing means and said motor for varying the torque generated by said motor in accordance with an eccentric force input signal and the output of said sensing means, to cause said transmission means to apply a predetermined torque to said gear corresponding to said eccentric force input signal only when said gear is rotating in a given direction.

17. An attachment for a weight stack type exercise machine having a plurality of weight plates, a pair of parallel vertical guide rods for maintaining said plates in vertical alignment, a selector bar operatively associated with said guide rods for supporting a weight stack, means for coupling a selected number of said plates to be included in the weight stack to the selector bar, and a toothed lifting belt for lifting the weight stack, said lifting belt having one end connected to the selector bar and another end connected to an exercise member, said attachment comprising:

an eccentric force drive motor;

a rotatable eccentric force control gear adapted to engage said toothed belt;

mechanical power transmission means for coupling said motor to said eccentric force control gear to apply a force to said gear which varies in accordance with the torque generated by said motor;

an angular position sensing means coupled to said power transmission means for determining the magnitude and direction of the speed of rotation of said eccentric force control gear;

a keypad for generating an eccentric force input signal in response to manual actuation thereof;

means for indicating the selected magnitude of said eccentric force input signal; and a microcontroller coupled to said sensing means, said keypad and said motor for varying the torque generated by said motor in accordance with said eccentric force input signal and the output of said sensing means, to apply (i) minimal force to the weight stack via said eccentric force control gear when said gear is rotating in one direction, and (ii) a predetermined torque to said eccentric force control gear corresponding to said eccentric force input signal when said gear is rotating in the opposite direction, so that the combined forces applied to said lifting belt by said weight stack and said eccentric force control gear may be coupled to said exercise member by said lifting belt.

18. In a weight stack type exercise machine having a weight stack and lifting means including a longitudinally movable elongated flexible element mechanically coupled between an exercise member and the weight stack, for manually raising and lowering the stack by application of longitudinal force to said elongated flexible element via said exercise member, the improvement comprising:

a drive motor;

eccentric force control means including said motor coupled to said elongated flexible element for subjecting said lifting means to a longitudinal force, in addition to the longitudinal force exerted on said lifting means by said weight stack, which varies in accordance with the torque generated by said motor;

sensing means for determining the direction of movement of said weight stack; and a microcontroller coupled to said sensing means and said motor for varying the torque generated by said motor in accordance with an eccentric force input signal and the output of said sensing means, to cause said eccentric force control means to subject said elongated flexible element to a predetermined longitudinal force, corresponding to said eccentric force input signal, when the stack is moving down, said predetermined longitudinal force being in addition to the longitudinal force exerted on said elongated flexible element by said weight stack.

19. An attachment for a weight stack type exercise machine having a plurality of weight plates and an elongated lifting belt for lifting the weight stack, said lifting belt having one end coupled to the weight stack and another end coupled to an exercise member, said attachment comprising:

force incrementing means for applying a variable longitudinal force to said belt, comprising a motor, drive means adapted to engage a portion of said belt and apply longitudinal force thereto, mechanical power transmission means for coupling said motor to said drive means, and control means for varying said force in accordance with a force increment control signal;

sensing means coupled to said force incrementing means for providing an output signal indicative of the magnitude and direction of the speed of movement of said portion of said belt;

manually operable input means for generating a weight increment signal; and a microcontroller coupled to said sensing means, said input means and said force incrementing means for generating said force increment control signal to vary said longitudinal force in accordance with said weight increment signal and said output signal, to apply a substantially greater longitudinal force to said portion of said belt when the belt is moving in one longitudinal direction that when the belt is moving in the opposite longitudinal direction, so that the combined forces applied to said lifting belt by said weight stack and said drive means may be coupled to said exercise member by said lifting belt to provide greater exercise resistance when said weight stack is moving down than when said weight stack is moving up.

* * * * *